US006213839B1

(12) United States Patent
Pedersen

(10) Patent No.: US 6,213,839 B1
(45) Date of Patent: Apr. 10, 2001

(54) TOY BUILDING SET

(75) Inventor: Niels Milan Pedersen, Mårslet (DK)

(73) Assignee: INTERLEGO AG, Baar (CH)

( * ) Notice: Subject to any disclaimer, the term of this patent is extended or adjusted under 35 U.S.C. 154(b) by 0 days.

(21) Appl. No.: 09/156,190

(22) Filed: Sep. 17, 1998

(30) Foreign Application Priority Data

Sep. 18, 1997 (DK) ..... 1071/97

(51) Int. Cl.[7] ..... A63H 3/00; A63H 33/12; A63H 33/00

(52) U.S. Cl. ..... 446/268; 446/490; 446/101

(58) Field of Search ..... 446/490, 101, 446/128, 268, 314, 315

(56) References Cited

U.S. PATENT DOCUMENTS 2,959,888 * 11/1960 Noble ..... 446/101 X
3,392,480 * 7/1968 Stubbmann ..... 446/101 X
3,477,167 * 11/1969 Ach ..... 446/101
4,205,482 * 6/1980 Christiansen et al. ..... 446/128 X
4,784,391 * 11/1988 Herron ..... 446/490 X

FOREIGN PATENT DOCUMENTS

3203460 * 9/1983 (DE) ..... 446/101

* cited by examiner

*Primary Examiner*—D. Neal Muir
(74) *Attorney, Agent, or Firm*—Pitney, Hardin, Kipp & Szuch LLP

(57) ABSTRACT

A toy building set is disclosed which includes a first type of building element formed of relatively flexurally flexible portions and a second type of building element having gripping fingers facing each other and spaced a distance apart that corresponds to the outer diameter of the flexurally flexible elements. The first type of building element may thus be releasably secured between the gripping fingers.

7 Claims, 2 Drawing Sheets

TOY BUILDING SET

CROSS REFERENCE TO RELATED APPLICATIONS

BACKGROUND OF THE INVENTION

The present invention relates to a toy building set comprising a first building element with the configuration of a substantially elongate element which is flexurally flexible and has a longitudinal direction and a predetermined outer diameter transversally to the longitudinal direction, and wherein the toy building set further comprises a second element provided with one or more gripping devices of the kind that features two gripping fingers with oppositely arranged receiving surfaces, said receiving surfaces being arranged at a mutual distance that corresponds to the predetermined outer diameter of the first building element, and a predetermined gripping width whereby the first building element may be introduced into and releasably secured between the gripping fingers.

Toys of this type are known today wherein the second element may optionally be a humanlike figure, an animal or the like, and wherein the first, substantially elongate, flexurally flexible element may be in the form of a liana, a rope or the like, on which e.g. the humanlike figure may be mounted by the gripping device, in this case optionally in the form of a hand, being pressed frictionally across the surface of the first, substantially elongate, flexurally flexible element.

In the known devices the substantially elongate, flexurally flexible elements are in the form of either a flexible rubber element of even thickness or an element which is also made entirely of rubber or the like plastic material, and wherein the surface of the element is corrugated in such a manner that, upon mounting on the elongate, flexible element, the gripping device spans a number of said corrugations.

However, since it is desired on the one hand to obtain a relatively high degree of holding force and on the other hand a very high degree of flexural flexibility, it is a problem of these prior art toy building sets that it is necessary to compromise which may mean that the elements do not allow for maximum holding force upon interconnecting or adequate flexural flexibility for the elongate, flexible element.

SUMMARY OF THE INVENTION

In the light of this, it is the object of the present invention to provide a toy building set that completely or partially remedies the above-mentioned drawbacks.

This is obtained with a toy building set of the kind described in the introductory part and which is characterised in that, in its longitudinal direction, the first building element consists of a number of alternately relatively flexurally flexible and relatively flexurally rigid portions, and wherein the relatively flexurally rigid portion(s) has/have a diameter that corresponds to the predetermined outer diameter, and that it extends uninterrupted in the longitudinal direction of the elongate, flexurally flexible element for a length that corresponds to or exceeds the predetermined gripping width for the receiving surfaces on the gripping fingers whereby the relatively flexurally rigid portions form coupling points for mounting the second type of building elements along the elongate, flexurally flexible element.

The elongate, flexurally flexible element thus consisting of alternately relatively flexurally rigid and flexurally flexible sections, and the flexurally rigid sections having such length which allows one of these to completely fill or cover the receiving surfaces, it is obtained that, ceteris paribus, a relatively strong holding force is obtained compared to the prior art while simultaneously enabling a very high degree of flexural flexibility of the elongate flexurally flexible element.

A preferred embodiment in accordance with the invention, where the relatively flexurally flexible portions on the elongate, flexurally flexible element have a diameter smaller than that of the predetermined outer diameter, enables the elongate flexurally flexible element to be flexed to very acute radii without yielding any resistance thereto.

According to a particularly advantageous embodiment which allows for the most expedient interconnecting of the elements, the relatively flexurally rigid portions of the elongate, flexible element are substantially circular-cylindrical with an outer diameter corresponding to the predetermined outer diameter for the elongate, flexurally flexible element, and wherein the receiving surfaces on the gripping fingers consist of substantially circular-cylindrical surfaces with a common axis of symmetry.

Particularly advantageously the elongate, flexurally flexible element has at least two relatively flexurally flexible portions arranged at a distance from each other which exceeds the diameter of the relatively flexurally rigid portions. This means that the elongate, flexible element may be flexed in very acute bends or radii without the relatively flexurally flexible portions touching each other with ensuing resistance to the flexing.

The elongate, flexible element may, in accordance with a particularly simple embodiment, consist of a flexurally flexible, elongate element which is of substantially even thickness, such as a thread, string, wire, cord or the like, on which the relatively flexurally rigid portions on the elongate, flexible element are permanently mounted, and such element is particularly simple to manufacture if the relatively flexurally rigid portions are made of a plastics material moulded permanently, e.g. in an injection moulding process, to the flexurally flexible, elongate element which is of substantially even thickness.

According to a preferred embodiment of the invention that exhibits a particularly increased play value of the elongate, flexurally flexible element, the toy building set may further comprise a third type of elements provided with coupling studs, and wherein the elongate, flexurally flexible element has two extremities, each of which being provided with a coupling means which is complementary to that of the coupling means on the third type of elements, with a view to mounting of the elongate, flexurally flexible element on the third type of elements.

BRIEF DESCRIPTION OF THE DRAWINGS

The invention will now be described in further detail with reference to the drawings, wherein.

DETAILED DESCRIPTION OF THE INVENTION

Figure 1:
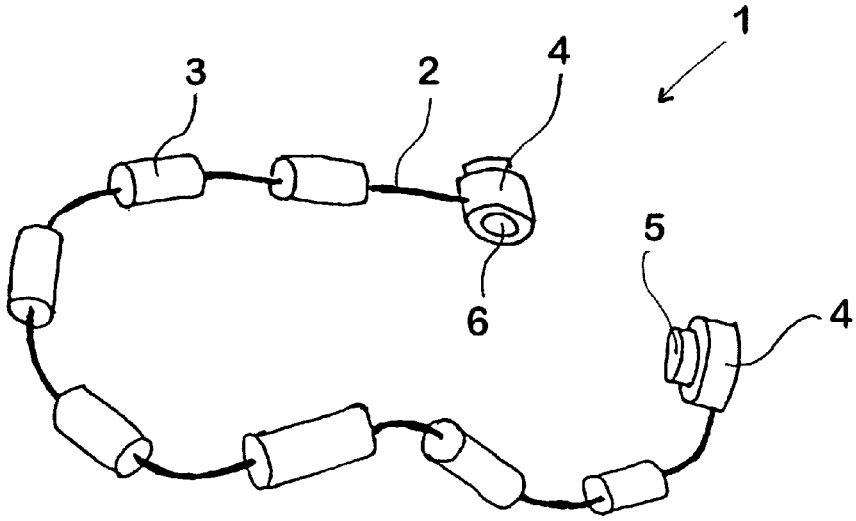
FIG. 1 illustrates an elongate, flexurally flexible element according to the invention.

Thus, a study of FIG. 1 will reveal an elongate, flexurally flexible building element 1 consisting of a wire, a thread or a string 2, having along said string 2 a number of relatively flexurally flexible portions 3 of an outer diameter that exceeds the diameter of the string 2, and wherein the string 2 has, at its ends, coupling means 4.

Thus, said coupling means 4 are provided with a coupling stud 5 on the one side and a coupling cavity 6 on the other side which is complementary to the coupling stud 5 thereby allowing the coupling element to be interconnected with a corresponding coupling element, or be mounted on another (not shown) element which is provided with coupling studs corresponding to the coupling stud 5, or coupling cavities corresponding to the coupling cavity 6 on the coupling means 4.

The relatively flexurally rigid portions 3 are, as will be revealed by study of the figure, configured as substantially circular-cylindrical pieces that may conveniently be made of impact-proof plastics, such as ABS, or some other material with similar mechanical properties. They all have the same outer diameter which means that the cylindrical surfaces on the flexurally rigid portions 3 constitute uniform coupling surfaces for mounting of another element, as will be described in the following.

As will appear, the distance between the individual, relatively flexurally rigid portions considerably exceeds the outer diameter on the relatively flexurally rigid portions whereby the string portions located between the individual, flexurally rigid portions, may be greatly flexed without the relatively flexurally rigid portions yielding any resistance to the flexing.

Figure 2:
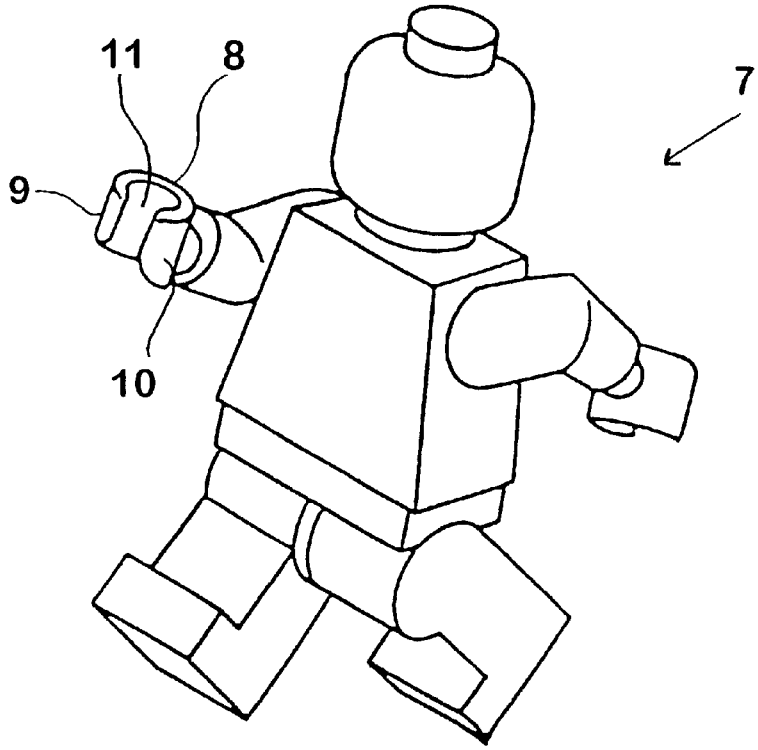
FIG. 2 illustrates a figure provided with a gripping device according to the invention.

Reference now being made to FIG. 2, a humanlike FIG. 7 is described which is provided with gripping devices 8 in the form of hands. These hands are in the form of a flexible gripping claw with two gripping fingers 9,10, and wherein the gripping fingers form a receiving surface 11 at their inside. This receiving surface 11 is configured substantially as a cylindrical surface with a diameter corresponding to or smaller than the outer diameter on the cylindrical surfaces on the relatively flexurally rigid portions 3 whereby the relatively flexurally rigid portions 3 on the elongate, flexurally flexible element 1 according to FIG. 1 may be mounted in the gripping device 8 on the humanlike figure according to FIG. 2.

Figure 3:
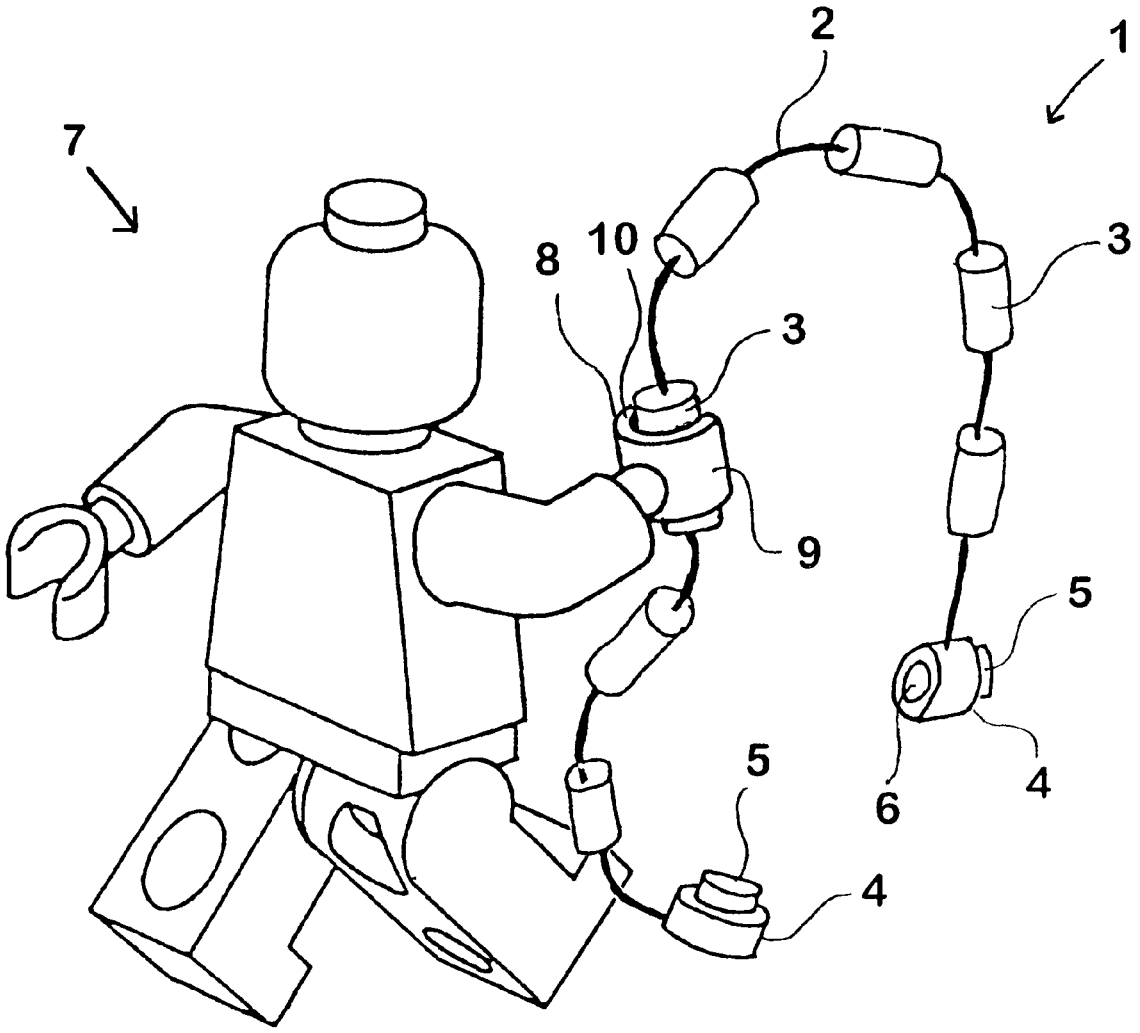
FIG. 3 illustrates the elongate, flexurally flexible element according to FIG. 1 and the figure shown in FIG. 2 in their interconnected state.

Hereby interconnecting is obtained as illustrated in FIG. 3 which shows that one of the relatively flexurally flexible portions 3 is introduced between the gripping fingers 9,10 on the gripping device 8 configured as a gripping claw. As will appear, the length of the relatively flexurally rigid portion 3 is such, relative to the gripping width of the gripping device 8, that the relatively flexurally flexible portion extends outwards to both sides of the gripping device 8.

Obviously the present invention may be provided with elements having other configurations than those illustrated in the figures, the design of the elements being, except from the features necessary to realise an interconnecting according to the present invention, of no consequence. Thus, the elongate, flexurally flexible element 1 may be in the form of a ring or have some other configuration where the relatively flexurally flexible portions are mounted at a distance from each other.

What is claimed is:

1. A toy building set comprising a first building element and at least one second building element;

said first building element being configured as a substantially elongate, flexurally flexible element with a longitudinal direction and consisting of a number of alternately relatively flexurally flexible and relatively flexurally rigid portions, said relatively flexurally rigid portions being fixed to said flexible element and having a predetermined outer diameter transversally to the longitudinal direction, said second building element having one or more gripping devices formed of two gripping fingers on which receiving surfaces are provided that face each other, said receiving surfaces being arranged at a distance from each other that corresponds to the predetermined outer diameter of the first building element and a gripping width whereby said first building element may be introduced into and releasably secured between the gripping fingers, whereby each relatively rigid portion extends uninterrupted longitudinally for at least a distance that corresponds to the gripping width of the receiving surfaces on the gripping fingers whereby the relatively flexurally rigid portions from coupling points for mounting said first type of building element along said second building element.

2. A toy building set according to claim 1, characterized in that the relatively flexurally flexible portions on the elongate, flexurally flexible element have a diameter which is smaller than the predetermined outer diameter.

3. A toy building set according to claim 1, characterized in that the relatively flexurally flexible portions on the elongate, flexible element are substantially circular-cylindrical with an outer diameter corresponding to the predetermined outer diameter of the elongate, flexurally rigid element, and wherein the receiving surfaces on the gripping fingers are constituted of substantially circular-cylindrical surfaces with common axis of symmetry.

4. A toy building set according to claim 2, characterized in that the elongate flexurally flexible element has at least two relatively flexurally flexible portions arranged at a distance from each other which exceeds the diameter for the relatively flexurally rigid portions.

5. A toy building set according to claim 1, characterized in that the elongate, flexible element consists of a flexurally flexible, elongate element which is of substantially even thickness, on which the relatively flexurally flexible portions of the elongate, flexible element are permanently mounted.

6. A toy building set according to claim 5, characterized in that the relatively flexurally rigid portions are made of a plastics material which is permanently moulded onto the flexurally flexible, elongate element which has a substantially even thickness.

7. A toy building set according to claim 1, characterized in that the toy building set further comprises a third type of elements provided with coupling studs, and that the elongate flexurally flexible element has two extremities, each of which being provided with a coupling means which is complementary to the coupling studs on the third type of elements, with a view to releasable mounting of the elongate, flexurally flexible element on the third type of elements.

* * * * *